United States Patent [19]

Williams et al.

[11] Patent Number: 5,035,168

[45] Date of Patent: Jul. 30, 1991

[54] BALANCE PIN ASSEMBLY FOR A PIANO KEY

[76] Inventors: Wayne T. Williams, 14330 12th Ave., N.E., #315M, Seattle, Wash. 98125; Steven L. Westfahl, 310 S. 3rd St., Laramie, Wyo. 82070

[21] Appl. No.: 520,365

[22] Filed: May 7, 1990

[51] Int. Cl.[5] ..... G10C 3/12

[52] U.S. Cl. ..... 84/435; 84/439

[58] Field of Search ..... 84/298–299, 84/313, 434–436, 439

[56] References Cited

U.S. PATENT DOCUMENTS

| | | | |
|---|---|---|---|
| 399,712 | 3/1889 | von Frankenberg | 84/402 |
| 806,949 | 12/1905 | Braun | 84/402 |
| 941,730 | 11/1909 | Sack et al. | 84/402 |
| 1,118,939 | 12/1914 | Lawrence | 84/435 |
| 1,223,412 | 4/1917 | Murdoch et al. | 84/402 |
| 2,065,342 | 12/1936 | Mockly | 84/202 |
| 2,965,451 | 12/1960 | Schmitt | 84/403 |
| 3,364,804 | 1/1968 | West | 84/202 |
| 3,605,545 | 9/1971 | Rendell | 84/298 |
| 3,651,732 | 3/1972 | Erbert et al. | 84/240 |
| 3,757,026 | 9/1973 | Carbone | 84/236 |
| 4,085,044 | 11/1977 | Murakami | 84/1.14 |
| 4,541,320 | 9/1985 | Sciuto | 84/298 |
| 4,579,033 | 4/1986 | Edwards | 84/314 N |

FOREIGN PATENT DOCUMENTS

| | | | |
|---|---|---|---|
| 132949 | 10/1919 | United Kingdom | 84/435 |

*Primary Examiner*—Lawrence R. Franklin

*Attorney, Agent, or Firm*—John R. Flanagan

[57] ABSTRACT

A balance pin assembly for mounting a piano key includes a balance pin, a mounting insert, and a self-locking pin. The balance pin has a lower externally threaded base, an intermediate annular shoulder, and an upper elongated stem with a top torque regulating head. The mounting insert has a central bore and is both externally and internally threaded for threading into a hole in a piano keybed rail member and for threadably receiving the base of the balance pin to establish the desired height of the piano key above the rail member. The torque regulating head is used to turn the pin and will shear off if the pin is overtightened in the insert thereby preventing stripping of the internal threads of the insert. The self-locking pin is inserted into a radial hole in the threaded base of the balance pin and projects therefrom so as to frictionally engage the internal threads of the insert to prevent rotational and rocking play of the pin relative to the insert after the pin has been rotatably adjusted relative to the insert to set the desired height of the piano key. The balance pin is composed of a material permitting slight bending of the pin once threaded into the insert to horizontally level the key mounted by the balance pin assembly.

8 Claims, 4 Drawing Sheets

BALANCE PIN ASSEMBLY FOR A PIANO KEY

BACKGROUND OF THE INVENTION

1. Field of the Invention

The present invention generally relates to a piano and, more particularly, is concerned with an improved balance pin assembly for a piano key.

2. Description of the Prior Art

Modern pianos are complex mechanisms made up of thousands of parts. The adjustment and setting of many of these parts affect the playing quality of the piano. Periodically, these parts loosen up and get out of adjustment requiring tuning and regulation.

During periodic regulation and tuning of a piano, one of the procedures that must be carried out is the leveling of the piano keys. This has traditionally been done by starting at one end of the piano and working toward the other end, all the while striving to make the keys line up with the edge of a long ruler that spans the keyboard.

Each key is balanced at approximately mid-length on a pin permanently installed in the piano keybed. To adjust its height, a key is individually lifted at the rear off its balance pin. Then, the key is raised or lowered either by inserting or removing ring-shaped paper shims of varying thicknesses. This procedure is repeated until the proper height is attained.

The balance pins over which the paper shims are inserted must also be capable of being bent by light tapping with a hammer in order to take out any sidewise roll, twist or tilt of the keys as they are seated on their balance pins. A piano keyboard with all the keys level and free of tilt is the end result of a procedure that can take up to three hours for the piano technician to complete.

The drawback with the traditional way in which keys are mounted is that the time required to adjust the heights of the keys is much too long. Consequently, a need exists for a different approach which will avoid this drawback.

SUMMARY OF THE INVENTION

The present invention provides an improved balance pin assembly for a piano key designed to satisfy the aforementioned needs. The present invention eliminates the need to repetitively lift the key and insert or remove paper shims to reach the desired height. Instead, by employing an elongated balance pin threadable into and from a mounting insert, the improved balance pin assembly of the present invention substantially reduces the time needed for making the adjustment to level all the piano keys.

Accordingly, the present invention is directed to an improved balance pin assembly for mounting a piano key. The balance pin assembly basically comprises an elongated balance pin and a mounting insert. The balance pin is cylindrical-shaped and has a lower externally threaded base, an upper elongated stem extending upwardly from the base and terminating in a top torque regulating head, and an intermediate annular shoulder rigidly attached proximate the juncture of the base and stem. When a piano key is mounted to the improved balance pin assembly, the stem of the balance pin extends upwardly through a slot in the piano key with the key resting on a felt washer seated on the shoulder of the pin.

The mounting insert is cylindrical-shaped, has a central bore and is both externally and internally threaded.

The external threads permit the insert to be threaded into a hole in a piano keybed rail member to stationarily and permanently install the insert therein. The internal threads permit the insert to threadably receive the base of the balance pin to establish the desired height of the piano key above the rail member.

The top torque regulating head of the balance pin is engageable by a tool for turning the pin. The head will shear off if the pin is overtightened in the insert to thereby prevent stripping the internal threads of the insert which would require replacement of the insert.

The improved balance pin assembly also includes a self-locking pin. The self-locking pin is inserted into a radial hole formed in the threaded base of the balance pin and projects therefrom so as to frictionally engage the internal threads of the insert. Such engagement prevents rotational and rocking play of the balance pin relative to the insert after the balance pin has been rotatably adjusted relative to the insert to set the height of the piano key above the piano keybed rail member.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Prior Art Balance Pin

Figure 1:
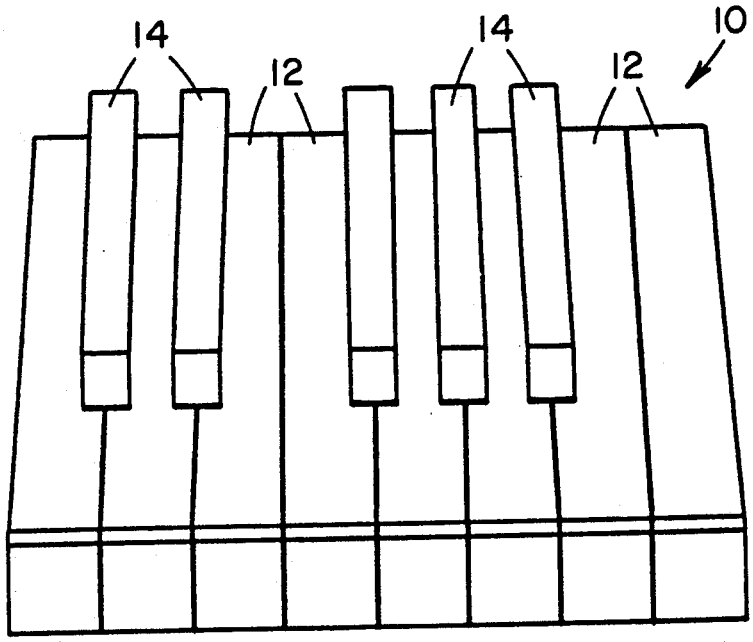
FIG. 1 (PRIOR ART)
FIG. 1 is a fragmentary perspective view of a prior art piano keyboard.
Figure 2:
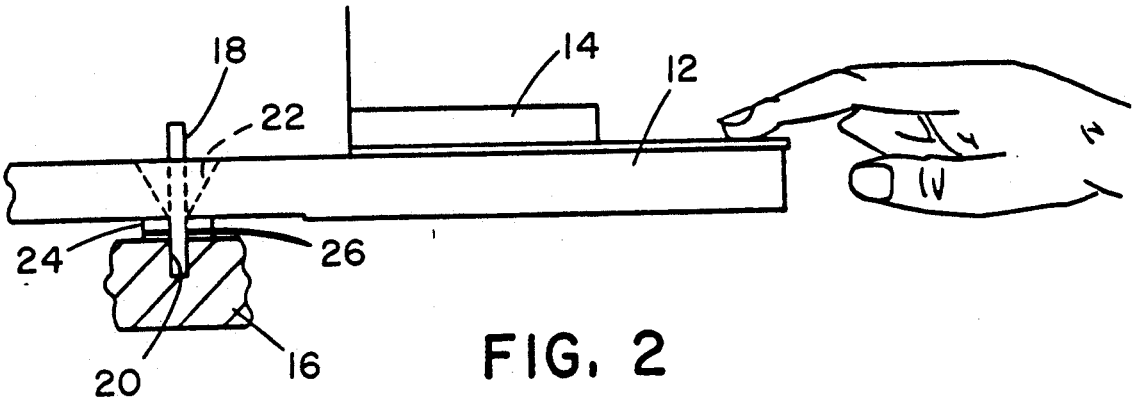
FIG. 2 (PRIOR ART)
FIG. 2 is a side elevational view of a piano key supported by a prior art balance pin and stack of felt and paper shims.
Figure 4:
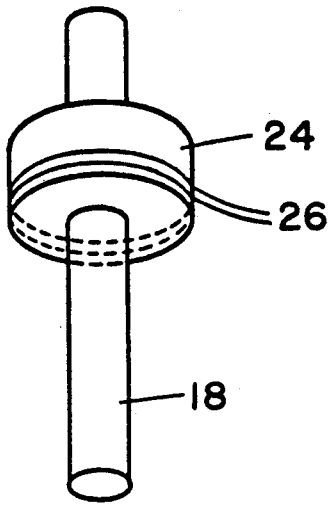
FIG. 4 (PRIOR ART)
FIG. 4 is a perspective view of the prior art balance pin and stack of felt and paper shims assembled together.
Figure 3:
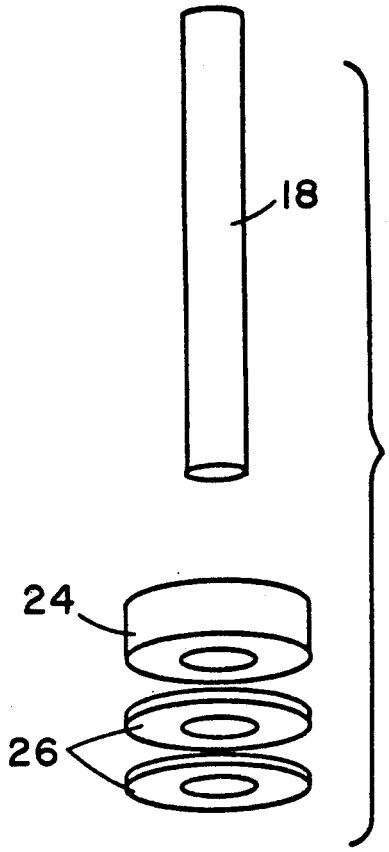
FIG. 3 (PRIOR ART)
FIG. 3 is an exploded perspective view of the prior art balance pin and stack of felt and paper shims.
Figure 5:
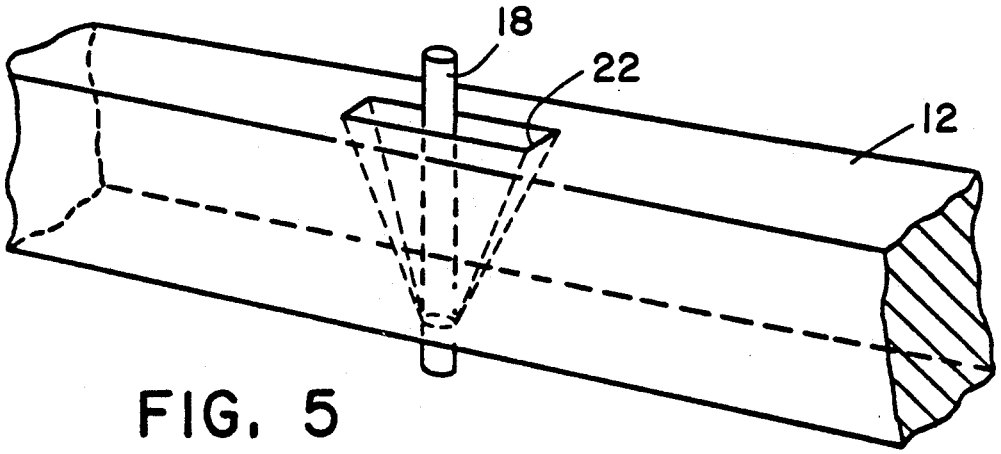
FIG. 5 (PRIOR ART)
FIG. 5 is a fragmentary view of the piano key mounted on the prior art balance pin.

Referring to the drawings, and particularly to FIGS. 1 to 5, there is shown a section of a prior art piano keyboard, generally designated 10. The keyboard 10 includes a plurality of keys 12 and 14 arranged side by side and extending in a horizontal plane above the piano keybed (not shown). The keybed includes a horizontal rail member 16 for supporting the piano keys 12 approximately midway between their opposite ends. The rail member 16 extends transversely across the keybed. A plurality of prior art balance pins 18 (only one being shown) are permanently mounted in spaced blind holes 20 (only one being shown) formed in the rail member 16. Each balance pin 18 extends upwardly through an upwardly flared slot 22 defined in each key 12 so as to pivotally mount the key 12 on the rail member 16. The key 12 is supported on the rail member 16 at the desired height by a stack of ring-shaped felt and paper shims 24 and 26 inserted over the balance pin 18 and seated on the rail member 16.

Thus, each key 12 is balanced at approximately mid-length by one of the balance pins 18 permanently installed in the piano keybed. To adjust its height, the key 12 is individually lifted at the rear off its balance pin 18. Then, the key 18 is raised or lowered either by inserting or removing paper shims 26 of varying thicknesses. This procedure is repeated until the proper height is attained.

The prior art balance pins 18 are composed of a material, such as low carbon steel, making them capable of being bent by light tapping with a hammer or other tool in order to take out any twist or tilt and thereby achieve leveling of the keys 12 as they are seated on their balance pins 18. As mentioned earlier, a piano keyboard 10 with all the keys 12 level and free of twist is the end result of a procedure that can take up to three hours for the piano tuner to complete.

Improved Balance Pin Assembly

Referring to FIGS. 6 to 14, there is illustrated an improved balance pin assembly 30 of the present invention for mounting each of the piano keys 12. The balance pin assembly 30 basically includes an elongated balance pin 32 and an insert 34 for mounting the pin 32.

More particularly, the elongated balance pin 32 of the improved assembly 30 is preferably cylindrical-shaped solid rod and has a lower externally threaded base 36, an upper elongated stem 38 extending upwardly from the base 36 and terminating in a top torque regulating head 40 of generally rectangular shape, and an intermediate annular shoulder 42 radially extending outwardly from and rigidly attached to the stem 38. The shoulder 42 is located proximate the juncture of the stem 38 with the base 36 such that the stem 38 extends above the shoulder 42 and the base 36 extends below it. When one of piano keys 12 is mounted to the improved balance pin assembly 30, the stem 38 of the balance pin 32 extends upwardly through the flared slot 22 in the key 12 with the key resting on a felt washer 44 inserted over the stem 38 and seated on the annular shoulder 42 of the pin 32.

The mounting insert 34 is cylindrical-shaped solid body, has a central cylindrical bore 46 and is both externally and internally threaded at 48 and 50. The external threads 48 of the insert 34 permits threading the insert into a blind hole 52 in a piano keybed rail member 16 in order to stationarily and permanently install the insert 34 therein. The hole 52 which receives the insert 34 is of larger diameter than the hole 20 which received the prior art balance pin 18. The internal threads 50 of the insert 34 permits threadably installing the balance pin base 36 into the central bore 46 of the insert 34 in order to establish the desired height of the piano key 12 above the rail member 16.

Figure 6:
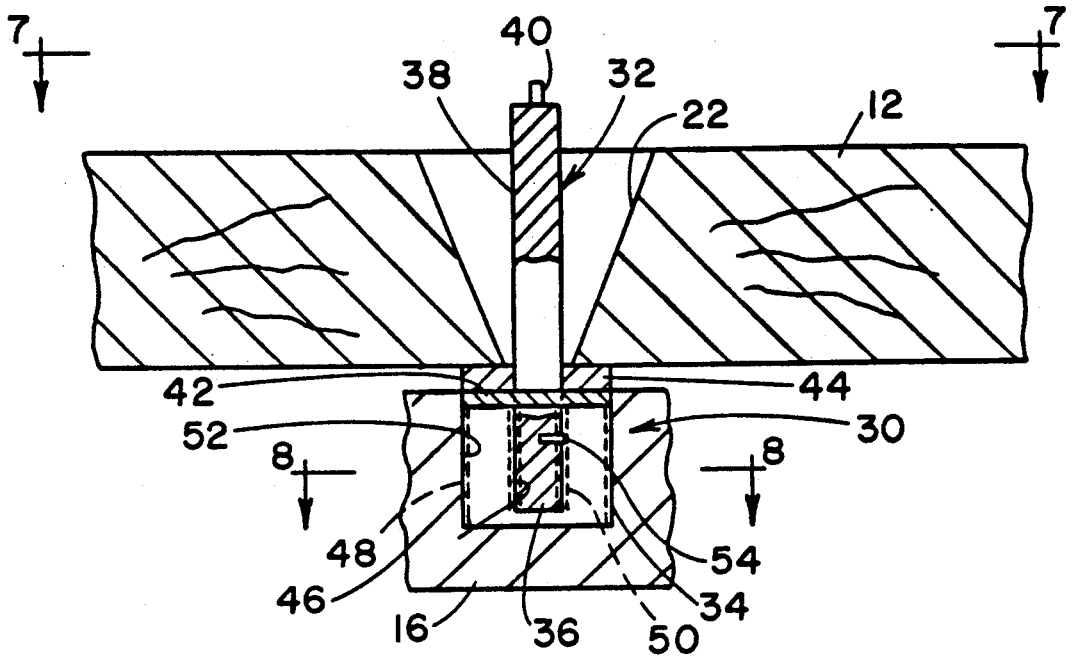
FIG. 6 is a fragmentary longitudinal sectional view of a piano key mounted on an improved balance pin assembly in accordance with the present invention.

As seen in FIG. 6, the balance pin 32 can only be threaded into the insert 34 to the point where the annular shoulder 42 bottoms on the top surface of the insert 34. Thus, the annular shoulder 42 on the balance pin 32, in addition to providing a seat for the washer 44 which supports the key 12, also limits how far the base 36 of the balance pin 32 can be threaded into the insert bore 46.

The top torque regulating head 40 on the stem 38 of the balance pin 32 is engageable by a tool for turning the balance pin 32. The head 40 will shear off if the balance pin 32 is overtightened in the insert 34 and the shoulder 42 is bottomed against the insert 34. Thus, the head 40 also serves to prevent stripping of the internal threads 50 of the insert 34 which would require replacement of the insert.

The improved balance pin assembly 30 of the present invention also includes a self-locking pin 54. The self-locking pin 54 is inserted into a radially-extending hole 56 formed in a side of balance pin base 36 adjacent the external threads thereon. The inserted self-locking pin 54 projects from the radial hole 56 so as to frictionally engage the internal threads 50 of the insert bore 46. Such engagement increases the coefficient of friction between the base 36 and insert 34 and thereby prevents rotational and rocking play of the balance pin 32 relative to the insert 34, due to existence of normal manufacturing tolerances, after the pin 32 has been rotatably adjusted relative to the insert 34 to set the height of the piano key 12 above the piano keybed rail member 16. Preferably, the self-locking pin 54 is composed of resiliently deformable material, such as a plastic like nylon, which will increase the coefficient of friction between the pin base 36 and insert 34, and thus slow, if not prevent entirely, sliding of the balance pin base threads down the insert internal threads 50.

Preferably, the balance pin 32 and insert 34 are fabricated from stainless steel, No. 303, to make them substantially immune to changes in temperature and humidity. However, other materials, such as aluminum, although less desirable, could be used.

The stem 38 of the balance pin 32 of the improved assembly 30 must be bendable the same as the prior art balance pin 18. The No. 303 stainless steel has a low yield strength (40 ksi) and a high ultimate strength (82 ksi). The ratio of the ultimate to the yield strength is high, indicating a material with good ductility. The modulus of elasticity for stainless steel ($29\times10^6$ psi) is close to that of steel ($30\times10^6$ psi), meaning that the improved balance pin 32 will behave much like the prior art balance pin 18 when tapped from side to side since both materials are virtually the same in terms of stiffness. The threading of the base 36 of the improved balance pin 32 into the insert bore 46 provide a strong connection that resists shearing when the balance pin 32 is tapped from side to side to remove twist or tilt of the piano key 12 resting on the shoulder 42 of the balance pin 32.

Figure 7:
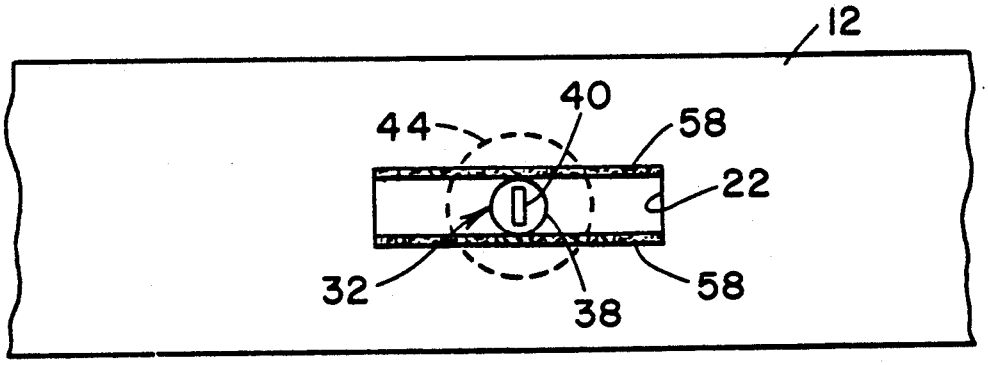
FIG. 7 is a top plan view as seen along line 7—7 of FIG. 6.
Figure 8:
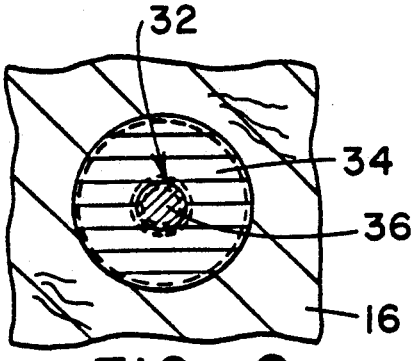
FIG. 8 is an enlarged sectional view taken along line 8—8 of FIG. 6.
Figure 9:
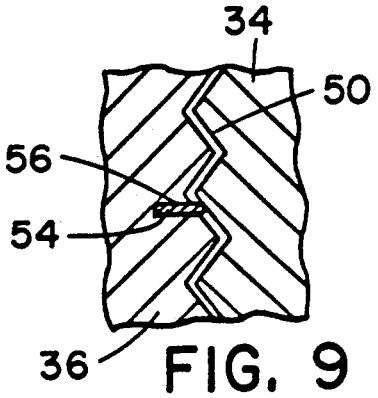
FIG. 9 is a fragmentary enlarged axial sectional view of the balance pin assembly illustrating a self-locking pin of the assembly.
Figure 11:
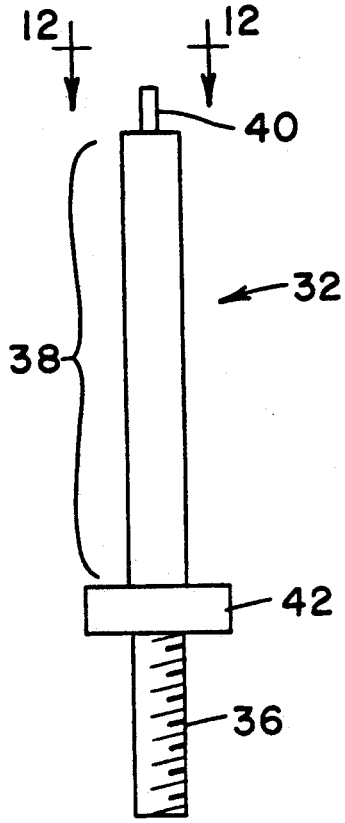
FIG. 11 is a side elevational view of the balance pin of the assembly of FIG. 10.
Figure 10:
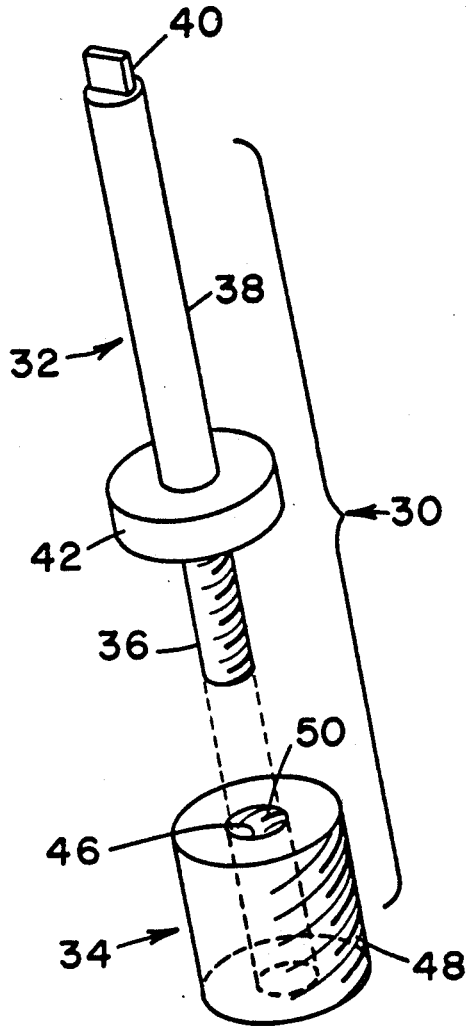
FIG. 10 is an exploded perspective view of the balance pin assembly of the present invention.
Figure 12:
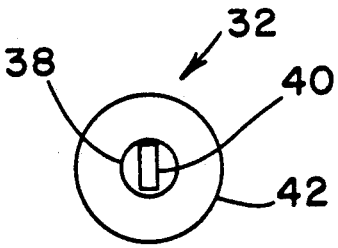
FIG. 12 is a top plan view as seen along line 12—12 of FIG. 11.
Figure 13:
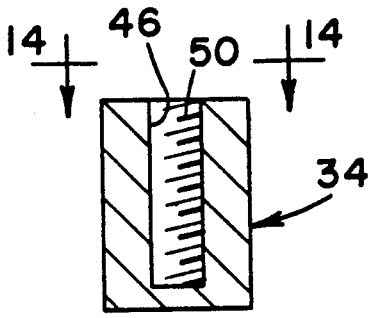
FIG. 13 is a side elevational view of the mounting insert of the assembly of FIG. 10.
Figure 14:
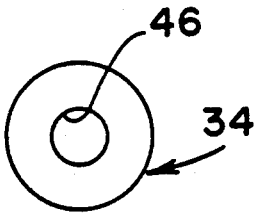
FIG. 14 is a top plan view as seen along line 14—14 of FIG. 13.

To install the externally-threaded insert 34 into the hole 52 of the rail member 16, a conventional bolt is first threaded into the insert 34 and then a conventional wrench is used to engage and turn the bolt, and the insert therewith, to thread the insert into the hole. After installation of the insert 34 is completed, the bolt is removed and the balance pin 32 is threaded into the insert 34. The key 12 is then installed with the balance pin stem 38 extending upwardly through the flared slot 22. As seen in FIG. 7, the slot 22 has a lining 58 which reduces friction between the key 12 and the balance pin 32. The balance pin 32 can be turned by a tool engaged with the head 40 of the balance pin to set the desired height of the key 12.

As an alternative to the use of the external threads 48 on the insert 34, a suitable epoxy material can be used to fix the insert 34 in place in the blind hole 52 of the rail member 16.

It is thought that the present invention will be understood from the foregoing description and it will be apparent that various changes may be made thereto without departing from its spirit and scope or sacrificing all of its material advantages, the form hereinbefore described being merely preferred or exemplary embodiment thereof.

We claim:

1. A balance pin assembly for mounting a piano key, said balance pin assembly comprising:

(a) an insert installable in a hole of a piano keybed and having a central bore with internal threads formed therein; and (b) an elongated balance pin installable into said central bore of said insert into frictional engagement therewith and adjustable in an axial direction into and from said insert to a set position for mounting a piano key at a desired height above said insert and thereby above the keybed of the piano, said balance pin including (i) a lower base having external threads thereon threaded into said internal threads of said insert bore, (ii) an upper elongated stem extending upwardly from said lower base and inserted through a slot in the piano key, (iii) an intermediate annular shoulder rigidly attached to, and radially projecting outwardly from, said stem of said pin proximate the juncture of said base and stem such that said shoulder can support the piano key with said stem extending upwardly through the slot in the piano key, and (iv) a head defined on a top end of said upper stem and configured for engagement by a tool to turn said balance pin for threading it into said insert, said head is shearable off said stem in response to overtightening of said external threads of said balance pin base within said internal threads of said insert bore to thereby prevent stripping of said internal threads of said insert.

2. The assembly as recited in claim 1, wherein said insert has external threads to permit threading of said insert into the hole in the piano keybed.

3. The assembly as recited in claim 1, further comprising:

means for engaging both said balance pin and said insert so as to increase the coefficient of friction therebetween for substantially locking said balance pin at said set position relative to said insert.

4. The assembly as recited in claim 3, wherein said engaging and locking means is self-locking pin composed of resilient deformable material.

5. In combination with a piano keybed and a piano key, a balance pin assembly, comprising:

(a) an insert installed in a hole of said piano keybed and having a central bore with internal threads formed therein; and (b) an elongated balance pin threaded into said central bore of said insert and adjustable in an axial direction into and from said insert to a set position for mounting said piano key at a desired height above said insert and thereby above said piano keybed, said balance pin including (i) a lower base having external threads thereon threaded into said internal threads of said insert bore, (ii) an upper elongated stem extending upwardly from said lower base and inserted through a slot in the piano key, (iii) an intermediate annular shoulder rigidly attached to, and radially projecting outwardly from, said stem of said pin proximate the juncture of said base and stem such that said shoulder can support the piano key with said stem extending upwardly through the slot in the piano key, and (iv) a head defined on a top end of said upper stem and configured for engagement by a tool to turn said balance pin for threading it into said insert, said head is shearable off said stem in response to overtightening of said external threads of said balance pin base within said internal threads of said insert bore to thereby prevent stripping of said internal threads of said insert.

6. The assembly as recited in claim 5, wherein said insert has external threads to permit threading of said insert into the hole in the piano keybed.

7. The assembly as recited in claim 5, further comprising:

means for engaging both said balance pin and said insert so as to increase the coefficient of friction therebetween for substantially locking said balance pin at said set position relative to said insert.

8. The assembly as recited in claim 7, wherein said engaging and locking means is a self-locking pin composed of resilient deformable material.

* * * * *